US007930847B2

(12) United States Patent
Lepley et al.

(10) Patent No.: US 7,930,847 B2
(45) Date of Patent: Apr. 26, 2011

(54) DURABLE DISPLAY APPARATUS WITH RETENTION LIP

(75) Inventors: Roger Mark Lepley, Kalamazoo, MI (US); Eastan James Bakka, Kalamazoo, MI (US)

(73) Assignee: Consort Corporation, Kalamazoo, MI (US)

( * ) Notice: Subject to any disclaimer, the term of this patent is extended or adjusted under 35 U.S.C. 154(b) by 409 days.

(21) Appl. No.: 11/986,663

(22) Filed: Nov. 26, 2007

(65) Prior Publication Data

US 2009/0133304 A1 May 28, 2009

(51) Int. Cl.
*G09F 3/18* (2006.01)

(52) U.S. Cl. ..... 40/661; 40/649; 40/650; 40/606.12; 40/606.18; 40/606.06

(58) Field of Classification Search ..... 40/649, 40/650, 661, 606.12, 606.18, 611.06, 538
See application file for complete search history.

(56) References Cited

U.S. PATENT DOCUMENTS 3,161,972 A * 12/1964 Newcomb et al. ..... 40/646
4,164,084 A 8/1979 Crockett
4,227,325 A 10/1980 Whitford
4,326,349 A * 4/1982 Daughtry ..... 40/733
4,327,514 A * 5/1982 Bourque ..... 40/607.06
4,329,801 A 5/1982 Clausen
4,432,151 A 2/1984 Morris
4,505,059 A 3/1985 Morris
4,534,126 A 8/1985 Gilman
4,558,527 A 12/1985 Schroedel
4,925,056 A * 5/1990 McCoig ..... 220/495.1
5,036,998 A * 8/1991 Dunn ..... 220/23.87
5,313,730 A 5/1994 Tiller
5,456,033 A 10/1995 Sachnoff
5,809,679 A 9/1998 Arjmand
5,933,994 A 8/1999 Misaresh
5,966,857 A * 10/1999 Pettersson et al. ..... 40/606.12
6,253,478 B1 * 7/2001 Kalavity ..... 40/645
6,256,912 B1 7/2001 Gibson
6,276,877 B1 * 8/2001 Crawford ..... 406/189
6,722,068 B2 * 4/2004 Ohlsson ..... 40/610
7,562,849 B2 * 7/2009 Pitcher et al. ..... 248/158

* cited by examiner

*Primary Examiner* — Gary C Hoge

(57) ABSTRACT

An advertising display apparatus comprising a hollow receiving tube with an essentially closed distal end and an essentially open proximal end enclosed within a base region, means for retaining a preprinted material inserted through said base region, wherein the hollow receiving tube comprises a plurality of faces where at least one face is transparent and through which said preprinted material may be viewed. The plurality of faces comprising the hollow receiving tube are preferably of a convex shape. Included within the base region is a retention lip which extends into and partially occludes the essentially open proximal end of the hollow receiving tube. The base region may include additional fitments to allow for attachment of the display apparatus to surfaces not of a flat horizontal orientation. The base region may further include means for producing light or sound.

2 Claims, 11 Drawing Sheets

DURABLE DISPLAY APPARATUS WITH RETENTION LIP

BACKGROUND

There exists a routine and recurrent need for persons to display information to the general public. This need can include purposes of informing others such as to promote a vendor's products or services and provide directions for performing a specific task. Other needs can include the desire of a person to present decorative embellishments or items of personal importance such as pictures, writings, or artwork.

The display information is often preprinted so as to support ease of replication and to allow for displayed information to be changed as warranted or desired. Often, a combination of a computer and a printer is suitable for creating such display information. Due to the ubiquitous nature of computers and the ready availability of diverse software to scan, create, and produce quality printings, there is a growing desire by users of such equipment to have means for displaying their printed works.

In and of itself, printed material is not suitable for protracted exposure to an environment. Environmental conditions often include elements that will soil printed material, such as fingerprints, contamination with food stuffs, and deposition of particulates, thus resulting in degradation of the quality of the printed material and loss of general attractiveness. This loss of quality issue has been noted and prior art attempts made to address means for maintaining the original state of the printed material while further enhancing the ability to display that printed material to the public. U.S. Pat. No. 4,505,059 to Morris is directed to a reusable display for business cards in a restaurant environment. The Morris display apparatus is designed to advantageously present business card information to diners, while requiring use of internal inserts within the display itself to maintain the printed material in the viewing face of the display. U.S. Pat. No. 4,534,126 to Gilman addresses the opportunity to display small format printed material in the form of a hollow tube check-out counter divider having removable ends and wherein the divider resides on one of the faces comprising the hollow tube allowing presentation of limited information in an elongate profile. U.S. Pat. No. 5,456,033 to Sachnoff describes a flat planar display wherein printed materials are captured between parallel faces in close proximity to one another. The aforementioned display apparatuses each offer a means for displaying printed material while offering protection of the printed material against environmental contamination. However, there remains an unmet need for a display apparatus that is simple to use, durable, stable, resistant to casual tampering and offers the ability to easily incorporate additional and integral attention garnering capabilities.

SUMMARY OF THE INVENTION

The present invention is directed to an advertising display apparatus comprising a hollow receiving tube with an essentially closed distal end and an essentially open proximal end enclosed within a base region, means for retaining a preprinted material inserted through said base region, wherein the hollow receiving tube comprises a plurality of faces where at least one face is transparent and through which said preprinted material may be viewed. The hollow receiving tube in conjunction with the essentially closed distal end and the proximal base end act to retain the preprinted material in a protected environment which aids in ensuring a clean, quality representation of the preprinted advertisement for protracted time periods, especially in environments where people may come into repeated contact with the display apparatus, such as restaurants, trade shows and retail sales stores. The plurality of faces comprising the hollow receiving tube are preferably of a convex shape for enhancing retention of the preprinted material and ensuring positive engagement of the preprinted material up to and against the respective face. Included within the base region is a printed material retention lip which extends into and partially occludes the essentially open proximal end of the hollow receiving tube. The base region is designed to allow the display apparatus to remain stable when set upon a flat horizontal surface and may optionally include additional fitments to allow for attachment of the display apparatus to surfaces not of a flat horizontal orientation. The base region may further include means for producing light or sound so as to enhance the attractive attention value of the display apparatus.

It is specifically within the purview of the present invention that the hollow receiving tube is proportioned to receiving a standard sheet of printed material. For example, the height and the width dimensions of the hollow receiving tube is equivalent to an eight and one half inch by eleven inch sheet of paper folded in half and positioned in a profile orientation. Alternate display apparatus dimensions can include other standard paper sizes in either profile or landscape orientations. A preferred embodiment of the present invention includes a hollow receiving tube comprising an optically clear composition having a front and back side, wherein the front and back faces of a folded eight and one half inch by eleven inch sheet are displayed through the respective front and back sides of the hollowing receiving tube. It is of further benefit that the hollow receiving tube and distal essentially closed end be formed into a monolithic structure at the time of manufacture so as to afford tamper resistance to the inserted printed material and provide the overall display apparatus enhanced structural durability through the reduction of pieces and joins. As will be noted in the attached diagrams, the durability of the preferred embodiment of the display apparatus is further enhanced through minimization of stress focal points as represented by the reduction of right angles in the construction of the apparatus and utilization of stress tolerant radii.

The base region of the display apparatus includes a flared aspect wherein the flared aspect resides against a surface during display of printed material and acts to provide stability to the display against inadvertent toppling caused by bumping into, or swaying of, the supporting surface. The base region may be integral to the hollow receiving tube or a separately formed piece that is permanently or temporarily affixed to the hollow receiving tube. The use of a snap in place base region is particularly preferred due to the ability to attach, remove and reattach the base for purposes of repeated transport or shipping of the display apparatus. The base region may also include additional ballasting; such as by application of a dense material (steel plate) to further improve tip-over resistance of the overall display apparatus.

The base region further affords an opportunity to incorporate active devices which increase the attention attracting attributes of the display apparatus. Devices can include such attributes as lighting, motion, smell and sound elements that enhance the attractive nature of the display. The device function can be predefined at the time of manufacture, selectable by the user so as to tailor the function commiserate with the desired advertising or information presentation, or selectable by the viewer of the display apparatus, such as the desire to indicate to others that additional service is required.

Other features and advantages of the present invention will become readily apparent from the following detailed description, the accompanying drawings, and the appended claims.

BRIEF SUMMARY OF THE FIGURES

The invention will be more easily understood by a detailed explanation of the invention including drawings. Accordingly, drawings which are particularly suited for explaining the inventions are attached herewith; however, it should be understood that such drawings are for descriptive purposes only and as thus are not necessarily to scale beyond the measurements provided. The drawings are briefly described as follows.

DETAILED DESCRIPTION

Figures 1, 2:
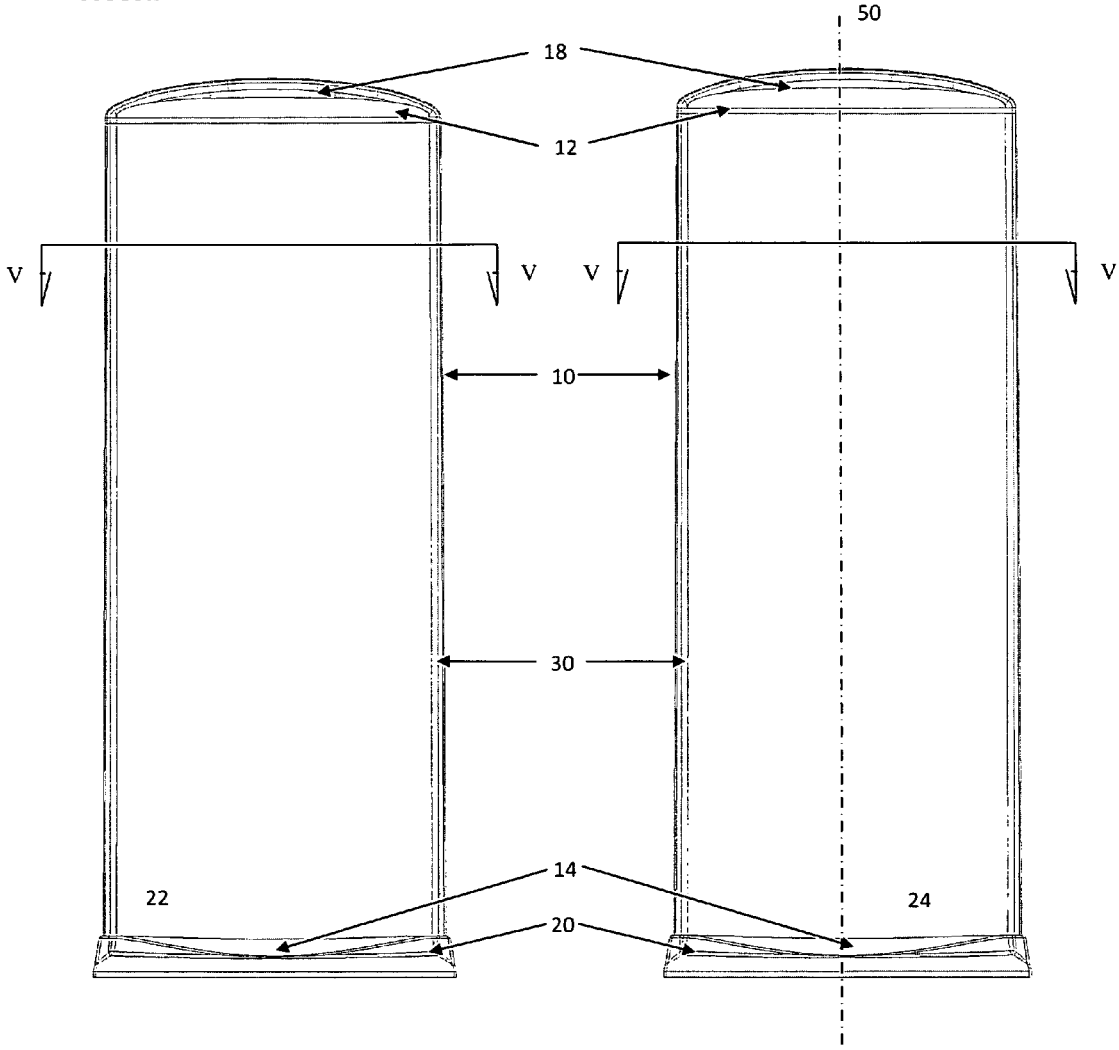
FIG. 1 a front view perspective of a display apparatus in accordance with the present invention having two convex faces.
FIG. 2 a rear view perspective of a display apparatus.
Figures 3, 4:
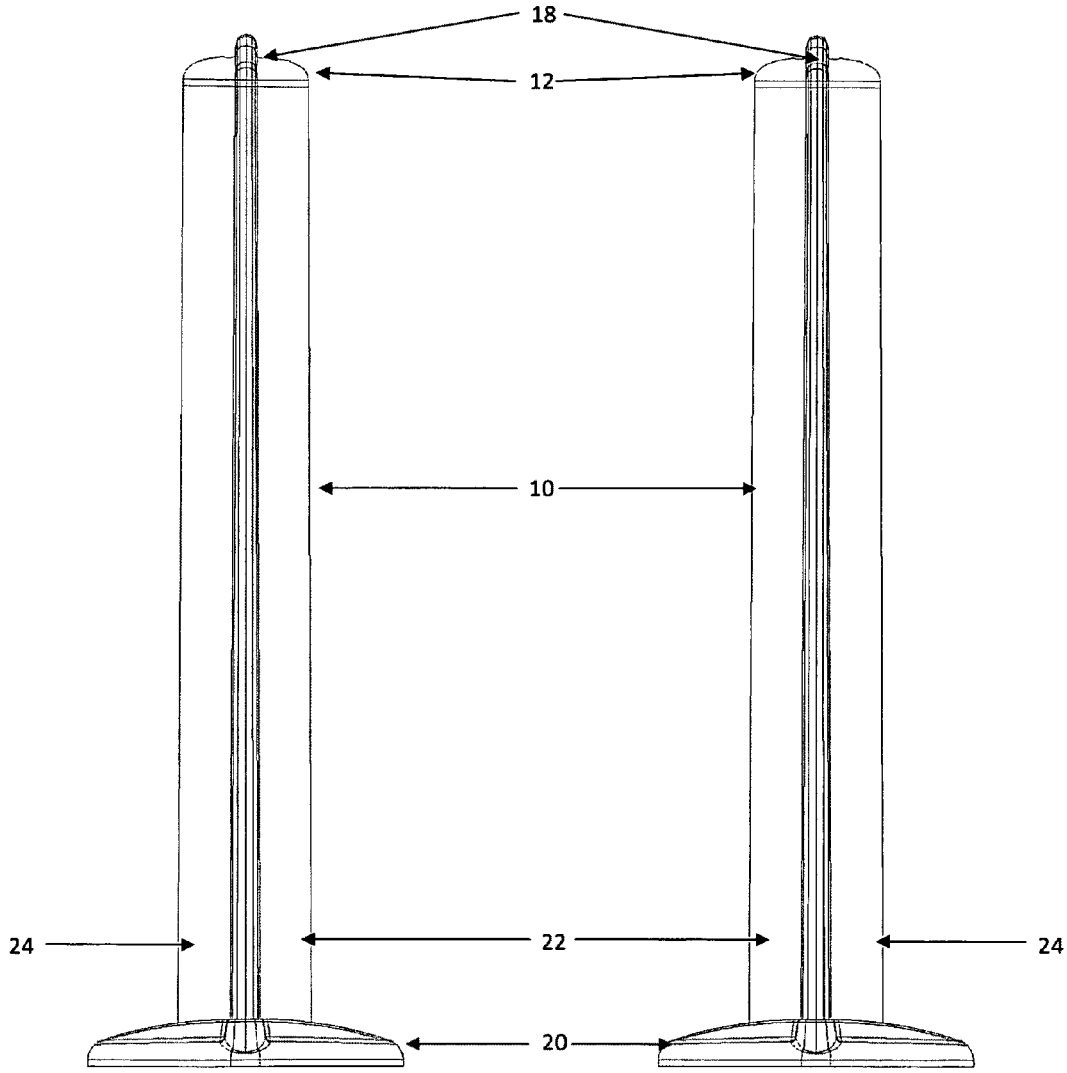
FIG. 3 a left side perspective of a display apparatus.
FIG. 4 a right side perspective of a display apparatus.
Figure 5:
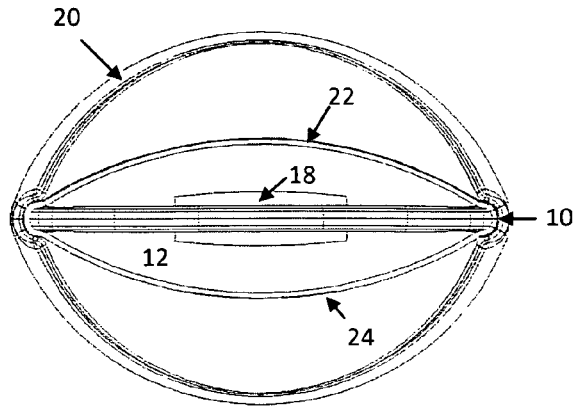
FIG. 5 a top down perspective of a display apparatus depicting an essentially closed distal aspect of the hollow receiving tube.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Referring to FIG. 1, therein is depicted display apparatus 1 in accordance with the present invention comprising a hollow receiving tube 10, an essentially closed distal aspect 12 and a base region 20 wherein the open proximal aspect 14 of the hollow receiving tube 10 is enclosed. The hollow receiving tube comprises a plurality of faces, which combine to form a hollow insertion volume 30. The plurality of faces comprising the hollow receiving tube are preferably of a convex shape for enhancing retention of the preprinted material and ensuring positive engagement of the preprinted material up to and against the respective face. In the representation of the display apparatus 1 in FIG. 1, and related FIGS. 2 through 6, the apparatus is shown with two faces, a front face 22 and a rear face 24 which in combination form hollow insertion volume 30.

The hollow receiving tube 10 is produced from a base composition selected from the group consisting of thermoplastic polymers, thermoset polymers, and combinations thereof. Suitable compositions include acrylic, polycarbonate, and polystyrene polymers. While the front face 20, rear face 22 and closed distal aspect 12 may be composed of differing base chemistries, it is preferred that a single base chemistry be used throughout the fabrication of the hollow receiving tube. The polymer composition can be readily formed into a hollow receiving tube through various moulding technologies, including exemplary technologies such as: continuous extrusion of a parison with a suitable cleaving and distal closure forming separation, such as taught in U.S. Pat. No. 7,261,854 to Arai et al., incorporated herein by reference; pressure moulding of the base composition into a defined mould, such as taught in U.S. Pat. No. 3,832,437 to Taylor, incorporated herein by reference; and, blow moulding, such as taught in U.S. Pat. No. 5,137,443 to Munoz et al., incorporated herein by reference. A preferred method of manufacture involved casting the entirety of the hollow receiving tube in a monolithic structure so as to improve durability through reduction of joins between separate components comprising the display apparatus. The essentially closed distal aspect 12 may contain an aperture vent 18 such as is sufficient for purposes of manufacturing and allow for equilibration of the environment within the hollow insertion volume 30 with the ambient environment in which the display apparatus is positioned. It is within the purview of the present invention that aesthetic and performance modifying admixtures and chemistries can be combined with the base composition so as to achieve attributes beyond those inherent to the base composition itself.

For the hollow receiving tube 10 to be suitable in performing the display attribute of the apparatus, at least one face includes an optically transparent area having an optical clarity index as measured by percent light transmittance per ASTM D1003 of at least 85%, thus forming a viewing face. The viewing face may have a surface area that is entirely optically transparent, or in the alternative, the viewing face may comprise one or more optically transparent areas that constitute a cumulative surface area less than the total surface area of the viewing face. Should the viewing face be comprised of one or more optically transparent areas, the intervening surface areas circumscribing the optically transparent areas may have alternate levels of opacity, coloration, tinting, or other visual delineation, wherein such intervening surface areas may be created through implementation in the fabrication process, such as altered moulding surfaces in those described regions, or through most fabrication modification such as printing or etching.

Figure 7:
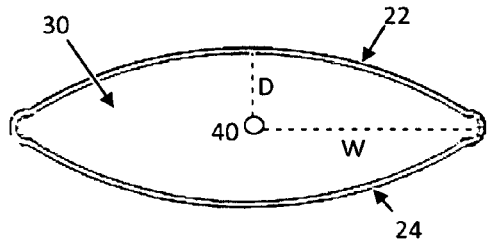
FIG. 7 is a cross-sectional profile of FIGURE taken along Line V-V.

The dimensions of the hollow receiving tube 10 are defined in part by the lengths and dimensions of the printed material to be inserted there into and the fractioning of that printed material by folding of the printed material to display through the viewing faces of the hollow receiving tube. For example, a display apparatus in accordance with the present invention designed to specifically receive printed material on a standard letter format in profile orientation of eight and one half inches wide by eleven inches tall, folded into equal long halves at the four and one quarter inch midpoint, would have a nominal display height equal to at least eleven inches and a display width of at least four and one quarter inches. In reference to FIG. 7 at least one face constituting the hollowing receiving tube, and preferably at least two faces exhibit a convex curvature extending away from a centroid 40 defined by the long axis 50 of the hollow receiving tube 10. The distance from the centroid to the closest point in the curve defining a convex face shall be designated D. The distance from the centroid to the furthest point in the curve defining a convex face shall be designated W. The cumulative total for the hollow receiving tube taken from each D and W for a given face shall equal D(sub)Total and W(sub)Total. The ratio of the display apparatus depth, D(sub)Total, and the display apparatus width, W(sub)Total, is defined as D(sub)Total:W(sub)Total, and is within the range of 1:1.1 to 1:10.0, preferably within the range of 1:2 to 1:6, and most preferably within the range of 1:3 to 1:4. The front face 20 and rear face 22 may exhibit the same or differing thickness, wherein the thickness does not adversely impact the legibility of the inserted printed material and is suitably durable for repeated use of the display device in a public environment. For example, when a polycarbonate resin is used as the compositional base polymer, the typical thickness range of a face is within range of 0.040 inch (1.02 millimeters) and 0.120 inch (3.05 millimeters), preferably within range of 0.050 inch (1.27 millimeters) and 0.100 inch (2.54 millimeters), and most preferably within the range of 0.060 inch (1.52 millimeters) and 0.080 inch (2.03 millimeters).

The base region 20 is produced from a base composition selected from the group consisting of thermoplastic polymers, thermoset polymers, and combinations thereof. The composition of the base region is not necessarily the same as used in the hollow receiving tube 10. The base region may be optically transparent or opaque and can include aesthetic and performance modifying chemistries. The base region may be formed as a separate piece in accordance with pressure moulding of the base composition into a defined mould, such as taught in the referenced Taylor patent; or in the alternative the base region can be formed integral with the hollow receiving tube 10. In order to attain suitable stability when set upon in a freestanding position on a surface, the surface area encompassed by the base region should be equal to or greater than the two (2) times the average cross sectional area of the hollow receiving tube 10. The performance of the display apparatus is not constrained by the exact profile of the base region so long as the aforementioned surface area requirement is met.

Figure 6:
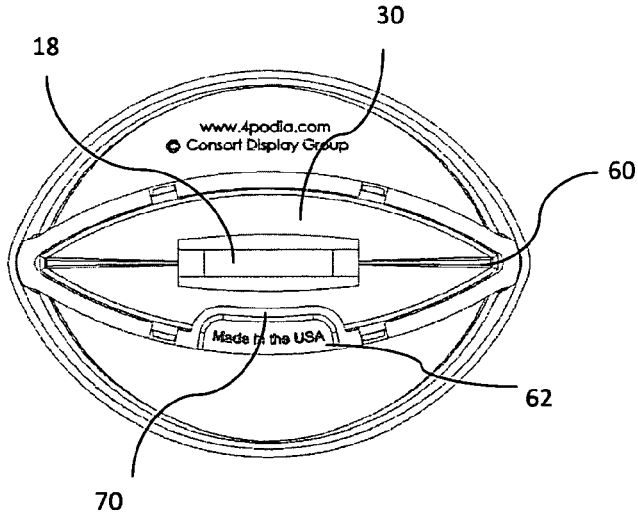
FIG. 6 a bottom up perspective of a display apparatus depicting an essentially open proximal aspect of the hollow receiving tube, the base region, and the partially occluding print retention lip.
Figure 8:
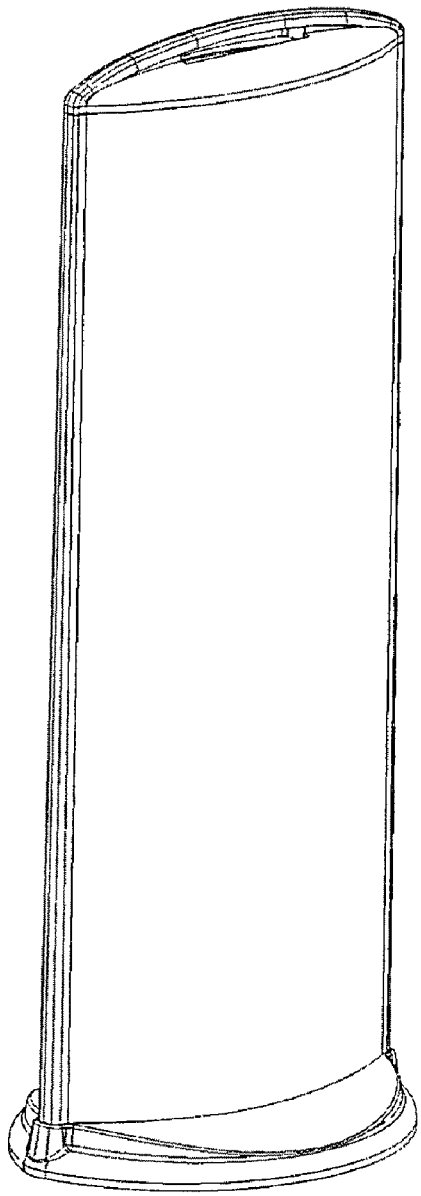
FIG. 8 is three-quarter plan view of a display apparatus.
Figure 9:
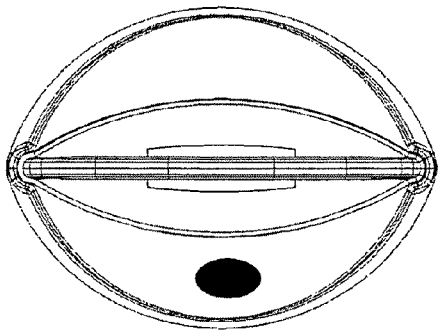
FIG. 9 is a top down perspective of a display apparatus depicting an essentially closed distal aspect of the hollow receiving tube and one active function device.
Figure 10:
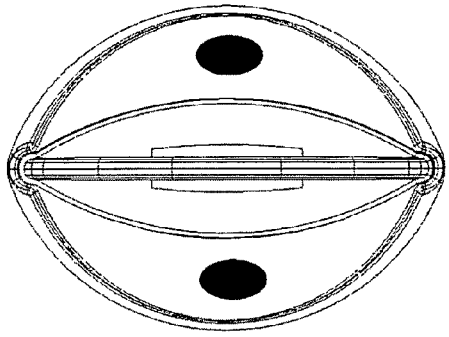
FIG. 10 is a top down perspective of a display apparatus depicting an essentially closed distal aspect of the hollow receiving tube and two active function devices.
Figure 11:
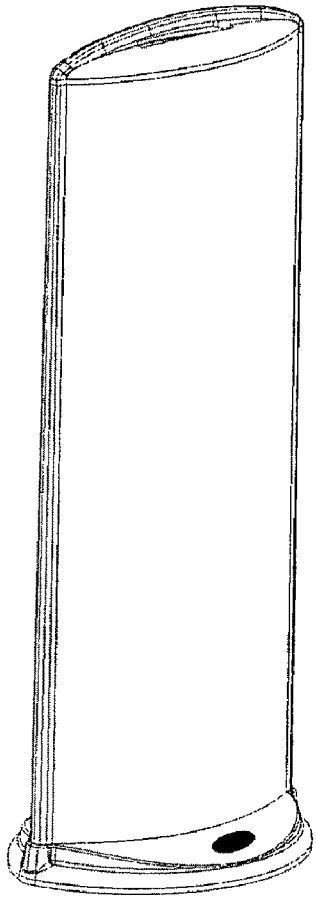
FIG. 11 is a three-quarter plan view of a display apparatus having an active function device embedded in the base region.
Figure 12:
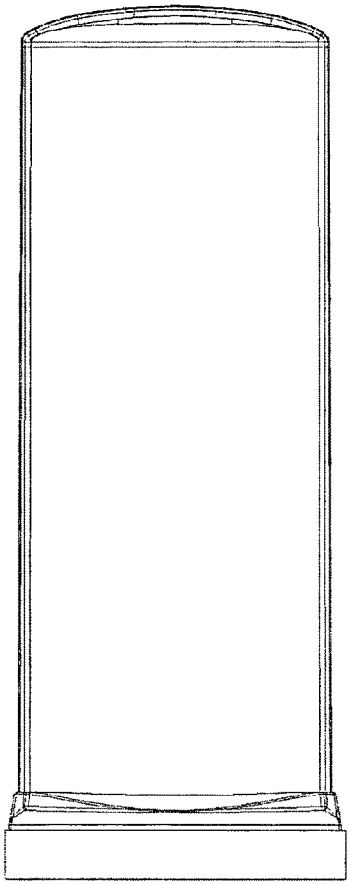
FIG. 12 is a front view perspective of a display apparatus in accordance with the present invention wherein the base region has been expanded to receiving an active function device.
Figure 13:
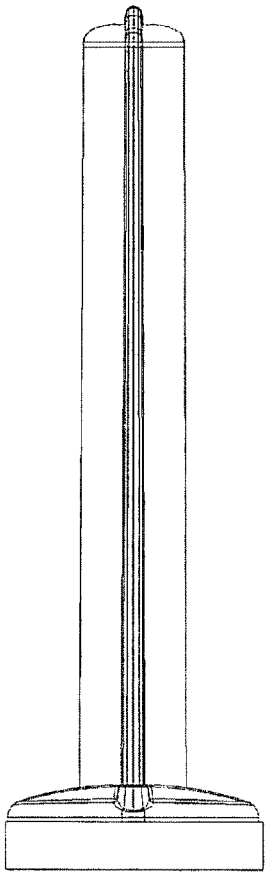
FIG. 13 is a side view perspective of a display apparatus in accordance with the present invention wherein the base region has been expanded to receiving an active function device.
Figure 14:
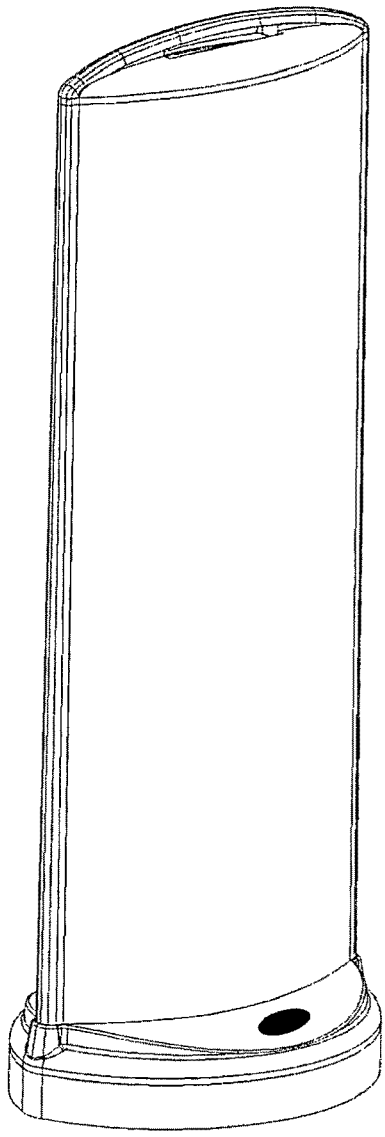
FIG. 14 is a three-quarter plan view of a display apparatus having an active function device embedded in a base region having an expanded dimension suitable for receiving the active function device.
Figure 15:
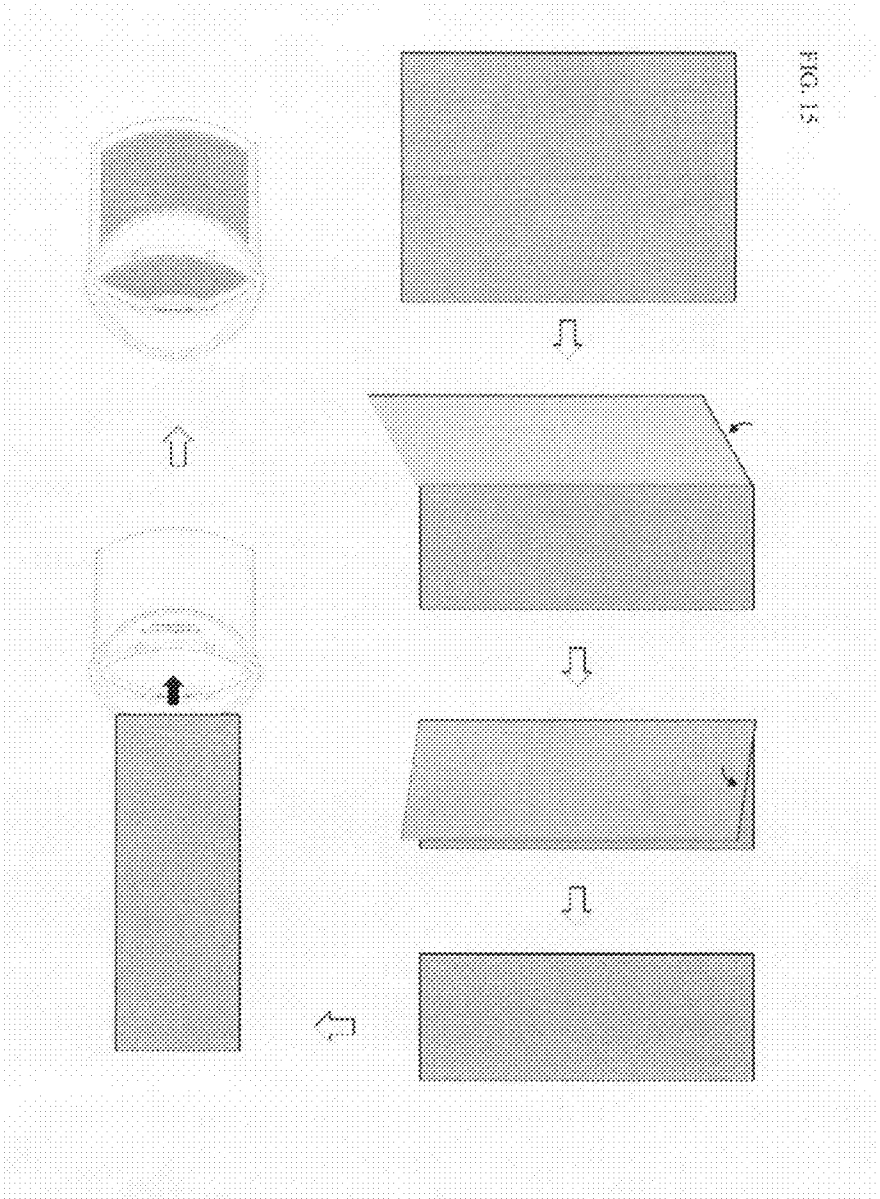
FIG. 15 is a schematic representation of a procedure for folding preprinted material and insertion thereof through access portal 60 into the hollow insertion volume 30 of hollow receiving tube 10.
Figure 16:
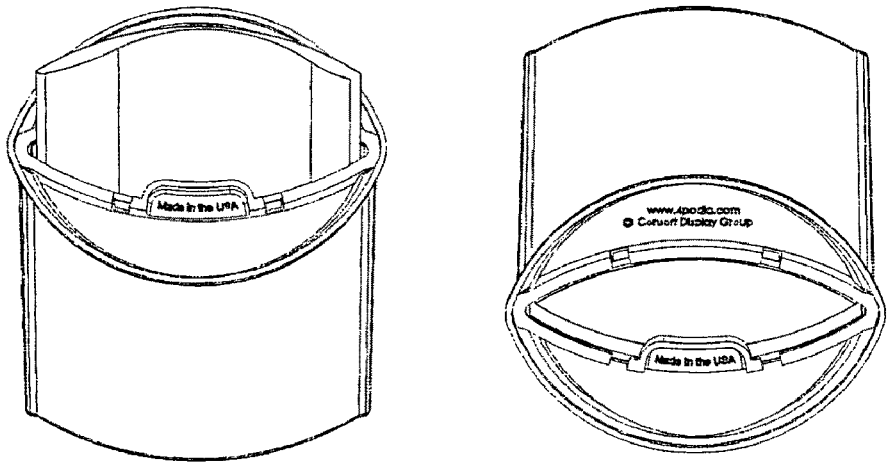
FIG. 16 is a schematic representation of a procedure for folding preprinted material and insertion thereof through access portal 60 into the hollow insertion volume 30 of hollow receiving tube 10, with particular distinction made as to the engagement of retention lip 62 upon the preprinted material.

FIG. 6 shows base region 20 having an access portal 60. Access portal 60 is of sufficient dimension to allow insertion of printed material into the hollow receiving tube 10 without undue or deleterious deflection of the printed material that might compromise the aesthetic attributes thereof. Preferentially, the dimensions of the access portal 60 are equivalent to the dimensions of the hollow receiving tube 10 where upon insertion of the printed material through access portal 60 the printed material conforms to the faces of the hollow receiving tube 10. Base region 20 further comprises at least one material retention lip 62 that extends from base region 20 into and partially occluding access portal 60. The retention lip 62 may be formed integral to the base region 20 or may be a separate piece such that the retention lip is durably or temporarily affixed to the base region 20 so as to provide its function. The material retention lip 62 acts to prevent the casual removal of the inserted printed material due to the retention lip impeding upon the printed material after the printed material has conformed to the faces of the hollow receiving tube 10. In order to remove the inserted printed material and replace with alternate printed material, a lower edge of the previously inserted printed material which is engaged upon the retention lip 62 is deflected manually away from and around the outer edge of said lip, thus allowing the printed material to be easily removed and the display apparatus reused. Retention lip 62 may have an essentially smooth flat surface 70 which impinges on the lower edge of the inserted printed material so as to prevent casual removal as shown in FIG. 15 and FIG. 16. In the alternative, retention lip 62 may be imparted with ridges, grooves, detents, tabs, posts, and similar three-dimensional surface asperities and/or be treated with temporary adhesives or friction modifiers so as to enhance the retentive capability of said lip.

The base region 20 affords an opportunity to incorporate devices which increase the stability of the overall display apparatus and attention attracting attributes of the overall display apparatus. Devices can include passive functions such as printing, stamping or embossing of logos or messages into or upon the base region 20, and/or the inclusion of active functions such as lighting/motion (visual), smell (olfactory) and sound (aural) elements that enhance the attractive nature of the display. The device function can be predefined at the time of manufacturer, selectable by the user so as to tailor the function commiserate with the desired advertising or information function, or selectable by the viewer of the display apparatus, such as the desire to indicate to others that additional service is required. Exemplary devices include, but are not limited to; light emitting diodes with associated circuitry and power source or connection; sound emitting siren to promote anti-handling of the display apparatus; and, thermal generating properties for a pre-scented strip or insert.

The base region 20 may optionally include various means for setting or affixing the display apparatus to a surface, particularly a surface that is either in motion or does not provide sufficient stability to the base region to maintain the display apparatus in an upright orientation in a display environment (particularly in windy, moving, or outdoor environs). A high density material, which includes any material of or greater than a density of 1.5, can be attached to or contained within the base region 20 so as to act as ballast and lower the effective center of gravity of the overall display apparatus, thus improving stability of the display apparatus against stimuli that might otherwise topple the display apparatus. For use in display environments that are especially conducive to toppling of the display apparatus, the base region 20 can be affixed directly to the support surface. Suitable affixing means include those that allow for replacement of the inserted printed material such as by affixing the base region 20 to a surface so that the hollow receiving tube 10 can be repeatedly reattached or by having an engagement within the base region 20 itself which allows for the entire display apparatus to be repeatedly reattached.

Example 1

A display apparatus in accordance with the present invention was fabricated having a separable hollow receiving tube and base region, wherein the following dimensions:

| | |
|---|---|
| Hollow Receiving Tube- | Total Height: 11.6 inches (295 mm)<br>Total Width: 4.4 inches (112 mm)<br>Total Depth: 1.3 inches (33 mm)<br>Profile Description: Two, convex opposed faces in edge to edgeorientation<br>D(sub) Total to W(sub) Total Ratio: 1:3.4<br>Total Cross Sectional Area: 6.4 inches$^2$ (4126 mm$^2$)<br>Average Face Thickness: .078 inch (2.00 mm)<br>Face Surface Area (height × width): 51.0 in$^2$ (33,000 mm$^2$)<br>Composition: Polycarbonate<br>Percentage Light transmittance: >95%<br>Means for engaging Base Region: Ramp tab<br>Mode of Fabrication: High pressure injection moulding with removable central mandrel; monolithic casting on front and back faces with essentially closed distal end |
| Base Region- | Total Height: 0.59 inch (15 mm)<br>Total Width: 3.6 inches (91 mm)<br>Total Length: 4.72 inches (120 mm)<br>Total Base Surface Area: 14.8 inches$^2$ (9585 mm$^2$)<br>Ratio of Hollow Receiving Tube Cross-sectional Area to Total Base Surface Area: 1:2.3<br>Access Portal Dimension<br>Composition: Polycarbonate<br>Percentage Light transmittance: Opaque |
| Display Apparatus (Hollow Receiving Tube inserted into Base Region)- | Total Height: 11.9 inches (303 mm) |

Centrifugal Testing

The example display was optimally designed to receive preprinted material as formatted onto a standard letter size sheet of paper having the dimensions of eight and one half inch width and an eleven inch height. The preprinted sheet is folded in to two equal halves at the width midpoint (four and one quarter inches) as shown in FIG. 15. The folded preprinted sheet was inserted through the access portal 60 in base region 20 until full loaded into the hollow receiving volume 30 in hollow receiving tube 10, whereupon the lower edge of the preprinted material came into direct contact with the retention lip 62. Upon insertion and engagement of the preprinted material into the display apparatus, the loaded display apparatus was held by the distal end 18 and aggressively rotated through 125° vertical angel at a speed of one (1) meter arc length per second. Despite the centrifugal and gravimetric forces, the preprinted material remained with the hollow receiving area 30 through the action of retention lip 62.

Impact Testing

An impact test was run wherein a hollow receiving tube comprising front and back faces integrally formed with an essentially closed distal end in accordance with the present invention was dropped from various heights to test the durability of the monolithic casting. A single test sample of the monolithic casting was evaluated at increasing heights ranging from four (4), seven (7) and ten (10) feet, with three subsequent tests run at each test height. The sample was then allowed to free fall with the essentially closed distal end leading onto a smooth, solid, horizontal concrete surface. The sample was retrieved post impact and closely examined for any structural failure or cracking. If no structural failure was found, the test was repeated. A prior art sample of a polycarbonate display apparatus of similar dimensions to Example 1 wherein the distal end is a separate and removable piece was included in the drop test for comparison (with the end cap inserted). The results are provided in Table 1.

TABLE 1

| | Drop Height | | |
|---|---|---|---|
| Sample | Drop #1 | Drop #2 | Drop #3 |
| Example 1 at 4 feet | Pass | Pass | Pass |
| Example 1 at 7 feet | Pass | Pass | Pass |
| Example 1 at 10 feet | Pass | Pass | Pass |
| Prior Art Sample at 4 feet | Failure | — | — |
| Prior Art Sample at 4 feet (Repeat) | Failure | — | — |

Static Load Testing

A static test was run wherein a hollow receiving tube comprising front and back faces integrally formed with an essentially closed distal end in accordance with the present invention was loaded with weight to test the compressive strength of the monolithic casting. A test sample of the monolithic casting was set onto its back face upon a smooth, solid, horizontal concrete surface so that the front face was oriented upwards. A defined weight was loaded onto the front face and closely examined for any structural failure or cracking. If no structural failure was found, the test was repeated with an increased weight. A prior art sample of a polycarbonate display apparatus wherein the distal end is a separate and removable piece was included in the drop test for comparison (with the end cap inserted). As will be noted, the prior art sample had to be tested at a reduced load in order to pass initial testing. The results are provided in Table 2.

TABLE 2

| Sample | Weight | Surface Area | Loading | Result |
|---|---|---|---|---|
| Example 1 | 175 pounds | 51 in$^2$ | 3.4 psi | Pass |
| Example 1 | 230 pounds | 51 in$^2$ | 4.5 psi | Pass |
| Prior Art Sample | 40 pounds | 51 in$^2$ | 0.8 psi | Pass |
| Prior Art Sample | 50 pounds | 51 in$^2$ | 1.0 psi | Failure |

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A display apparatus comprising a hollow receiving tube composed of a polymer resin having a light transmittance value per ASTM D1003 of at least 85%, said hollow receiving tube having an integrally formed and essentially closed distal end and an essentially open proximal end located within a separable base region affixed thereto, wherein said separable base region includes an aperture for loading a preprinted material and a retention means for retaining said preprinted material within the hollowing receiving tube, wherein said hollow receiving tube comprises a plurality of outward oriented faces where at least one face is transparent and through which said preprinted material may be viewed, wherein said hollow receiving tube is formed from plastic comprising a base resin, wherein said hollow receiving tube has a total depth (D(sub)Total) and a total width (W(sub)Total) measured from a centroid point defined by a long axis measure of the hollow receiving tube, said ratio of D(sub)Total to W(sub) Total is within the range of 1:1.1 and 1:10.0, said hollow receiving tube having a compressive strength of at least 1.0 psi and a drop test durability of at least four feet without structural failure.

2. A display apparatus as in claim 1, wherein said separable base region exhibits a surface area equal to or greater than two times an average cross sectional area of the hollow receiving tube.

* * * * *